US005364242A

United States Patent [19]

Olsen

[11] Patent Number: 5,364,242

[45] Date of Patent: Nov. 15, 1994

[54] PUMP APPARATUS AND METHOD INCLUDING DOUBLE ACTIVATION PUMP APPARATUS

[75] Inventor: James M. Olsen, Plymouth, Minn.

[73] Assignee: Pharmacia Deltec, Inc., St. Paul, Minn.

[21] Appl. No.: 981,832

[22] Filed: Nov. 25, 1992

[51] Int. Cl.[5] ..... A61M 5/00

[52] U.S. Cl. ..... 417/474; 417/476; 417/477.3; 604/153; 74/567; 74/569

[58] Field of Search ..... 417/476, 474, 477, 479, 417/494, 490; 74/567, 569; 604/153; 128/DIG. 12

[56] References Cited

U.S. PATENT DOCUMENTS

| | | | |
|---|---|---|---|
| 1,480,256 | 1/1924 | Gates | 417/474 |
| 2,423,701 | 7/1947 | Hardy | 417/490 |
| 2,813,523 | 11/1957 | Bischoff | 417/494 |
| 2,871,796 | 2/1959 | Dreisin et al. | 417/494 |
| 3,371,610 | 3/1968 | De Luca et al. | 417/494 |
| 4,017,220 | 4/1977 | Hotine . | |
| 4,352,296 | 10/1982 | Wendler | 74/569 |
| 4,535,641 | 8/1985 | Kriz et al. | 74/569 |
| 4,559,038 | 12/1985 | Berg et al. | 417/474 |
| 4,565,542 | 1/1986 | Berg . | |
| 4,650,469 | 3/1987 | Berg et al. | 417/474 |
| 4,680,930 | 7/1987 | Dollison . | |
| 4,681,513 | 7/1987 | Saito et al. . | |
| 4,687,426 | 8/1987 | Yoshimura . | |
| 4,730,992 | 3/1988 | Ogawa . | |
| 4,791,327 | 12/1988 | Bertram et al. | 74/569 |
| 4,803,889 | 2/1989 | Harris | 74/569 |
| 5,017,059 | 5/1991 | Davis . | |
| 5,127,907 | 7/1992 | Coutr . | |
| 5,165,873 | 11/1992 | Meijer | 417/474 |

FOREIGN PATENT DOCUMENTS

| | | | |
|---|---|---|---|
| 242874 | 12/1911 | Germany | 417/490 |
| 783971 | 10/1957 | United Kingdom | 417/520 |

*Primary Examiner*—Richard A. Bertsch
*Assistant Examiner*—Roland G. McAndrews, Jr.
*Attorney, Agent, or Firm*—Merchant, Gould, Smith, Edell, Welter & Schmidt

[57] ABSTRACT

A drug pump is disclosed having at least one rotatable cam and a reciprocally mounted follower engaged with the cam, and a tube which is compressed by the follower during rotation of the cam. The drug pump preferably has three followers, including an expulsor follower, an inlet valve follower, and an outlet valve follower. Three cams are provided to reciprocally move the followers, with one cam engaging each follower. The cams are interconnected by a cam shaft. The drug pump is ambulatory and provides two activations per revolution of the cams. The tube loading is nonlinear. Such nonlinear tube loading is taken into consideration to minimize energy consumption and to reduce peak torque loads. A design optimization and manufacturing system is provided to optimize energy consumption of the pump.

7 Claims, 10 Drawing Sheets

PUMP APPARATUS AND METHOD INCLUDING DOUBLE ACTIVATION PUMP APPARATUS

FIELD OF THE INVENTION

The present invention relates to peristaltic pumps which pump fluid through a tube by activation of one or more tube engaging members operated by a rotating cam shaft. The present invention also relates to the design and the manufacture of rotatable cams and reciprocally mounted followers.

BACKGROUND OF THE INVENTION

Various ambulatory medical devices are known for pumping drugs and other fluids to a patient from a fluid reservoir. Ambulatory drug pumps may include a rotatable cam shaft which has one or more cams that activate one or more tube engaging members in a particular sequence to pump fluid through the tube, as in a peristaltic pump.

An example of a peristaltic type pump is described and shown in U.S. Pat. No. 4,559,038, issued Dec. 17, 1985, to Berg et al., incorporated herein by reference. In U.S. Pat. No. 4,559,038, a rotating cam shaft is provided with three cams. Each cam engages one of two reciprocating valve followers or a reciprocating expulsor follower. The valve followers and expulsor follower engage a tube which provides fluid communication between a fluid reservoir and the patient. The rotating cam shaft moves the valve followers and expulsor follower in appropriate manners to pump fluid through the tube.

Ambulatory drug pumps frequently have a power supply including a replaceable battery or other replaceable or rechargeable power supply. Energy consumption is a significant concern. The shorter the life of the power supply, the more frequently the power supply must be replaced or recharged.

Peak torque loads applied to the cam shaft can also be a significant concern. If the peak torque loads that occur during operation exceed the demand capability of the power supply, the pump may stop operating. The patient drug therapy may be interrupted. This could be potentially harmful to the patient. Also, relatively large power supplies may be needed to ensure that the maximum torque loads do not stop the pump.

There is a need for peristaltic pump apparatus for pumping fluid to a patient where total energy consumption is emphasized to improve or maximize performance. There is also a need for peristaltic pump apparatus for pumping fluid to a patient where peak torque loads are emphasized to maximize or improve performance. Further, there is a need for methods of design and manufacture of rotatable cams and reciprocally mounted followers that emphasize total energy consumption and peak torque loads to improve performance for existing designs and to maximize performance for new designs.

SUMMARY OF THE INVENTION

A pump apparatus is provided having a rotatable cam shaft with at least one cam, and a reciprocally mounted follower engageable with a compressible tube. The follower is reciprocally mounted to a chassis of the pump apparatus. The energy consumed to rotate the cam shaft is minimized and the peak torque loads applied to the cam shaft are minimized by taking into consideration the non-linear tube loading applied to the cam shaft during rotation of the cam shaft to operate the pump. Specifically, the cam surface of the rotatable cam and the follower surface of the reciprocally mounted follower are configured and arranged to minimize the energy consumption and the peak torque loads during pump operation.

The pump apparatus may include a plurality of cams and followers wherein the cam surface of each of the cams and the respective follower surface of each of the followers are configured and arranged to minimize the total energy consumption and the total peak torque loads. In one embodiment, the pump apparatus includes three cams and three followers in a peristaltic pump apparatus, with each follower interacting with one cam. One cam activates a first follower functioning as an expulsor, and the two other cams interact with the remaining two followers functioning as inlet and outlet valves, respectively, on opposite sides of the expulsor.

The present invention also relates to a peristaltic drug pump apparatus which includes two activations per revolution of a cam shaft and reciprocally mounted inlet and outlet valves, and a reciprocally mounted expulsor.

A method of cam and follower design and manufacture is provided to design and manufacture a pump with one or more followers compressing a tube during rotation of one or more cams. An initial cam and follower design is provided or selected. The initial cam and follower design is optimized to result in a cam and follower design which is energy efficient and does not have excessively high peak torques. In the design optimization, the force necessary to compress the tube a predetermined amount with each of the followers in the cam and follower design is measured or otherwise obtained. The torques supplied to each of the cams in the cam and follower design are calculated when the follower compresses the tube at a plurality of different predetermined amounts utilizing the tube compression data measured or obtained previously. The energies to rotate the cams in the cam and follower design a predetermined amount are calculated utilizing the tube compression data. The calculation of the torques and the energies permits analysis of the energy consumed and the peak torque loads supplied to the cams to permit optimization of the cam and follower design. Once the cam and follower design is optimized, the cams and the followers are manufactured according to the energy efficient design.

The method of cam and follower design and manufacture also includes a calculation and analysis of the separate energy losses that comprise the total energy lost in the system. The separate energy components include: the frictional energy losses at each of the cam to follower interfaces, the frictional energy losses at each of the follower to chassis interfaces, and the energy losses due to tube hysteresis effects during compression and expansion of the tube. An analysis of the separate energy losses helps facilitate energy and peak torque optimization since the various energy losses can be isolated and design improvements made.

One method of cam and follower design optimization is to vary the follower motion, specifically the maximum velocity and its timing, to accommodate the non-linear tube load during compression of the tube until an optimal design is achieved. Another method of cam and follower design optimization is to vary the follower shape to minimize frictional loads applied to the follower by the chassis until an optimal design is achieved. A further method of cam and follower design optimization is to vary the base circle radius of the cam and/or the amount of cam rotation for one activation until an optimal design is achieved.

The method of cam and follower design and manufacture is particularly useful for increasing efficiency and reducing peak torque loads for existing pumps since the tube loading equation (tube compression data) must be determined or otherwise obtained. Such determination is facilitated by the presence of the existing pump where the tube compression data can be measured using the tube and the follower. Improvements for some existing designs can be made by only changing the cam profile and/or the follower profile of the cam engaging surface.

The present invention also relates to an automated cam shaft design and manufacturing system for producing a cam shaft including a plurality of cams, where the cam shaft is useable in a pump to rotate and move a plurality of followers to each compress a tube in the pump. The system comprises a computer, user input means to the computer, and display means for displaying information output from the computer. The computer is programmed with various program means. A first design program means computes and displays a plurality of torque values associated with the torques applied to a cam shaft of a proposed design. The proposed design includes a plurality of preselected design parameters necessary for torque calculation and energy calculation. At least one of the preselected design parameters is input to the computer by the user. A second design program means is provided to compute and display an energy consumed value for the cam shaft for the proposed design. A third design program means creates a control signal representative of the cam profile of each cam according to the preselected design parameters of the proposed design. Cam grinding means is provided to receive the control signal and manufacture the cam shaft to correspond with the preselected design parameters of the proposed design. The system is useable to optimize the cam shaft design for the preselected design parameters. Variations are made by the user to at least one design parameter input by the user to optimize the design. Preferably, the preselected design parameters input by the user include a specified shape for the follower surface of each follower, a specified follower motion for each follower, a specified cam base circle radius for each of the cams, and a specified cam shaft rotation amount. The system further includes a display presentation program means for displaying a cam profile of each cam of the cam shaft, another display presentation program means for displaying the torque supplied to each cam of the cam shaft on a graph of torque verses cam shaft rotation, and a further display presentation program means for displaying the total torques applied to the cam shaft on a graph of torque verses cam shaft rotation.

These and other features of the present invention are described in greater detail in the following detailed description of the preferred embodiments.

BRIEF DESCRIPTION OF THE DRAWINGS

In the drawings, where like drawings refer to like features throughout the several views.

DETAILED DESCRIPTION OF THE PREFERRED EMBODIMENTS

Figure 1:
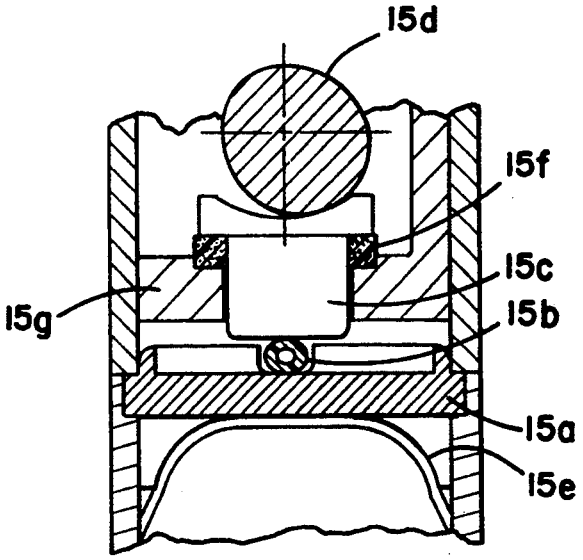
FIG. 1 PRIOR ART
FIG. 1 is a partial cross-sectional end view of a portion of a prior art pump apparatus.

FIG. 1 relates to a prior art pump apparatus 15, or pump, similar to that disclosed in U.S. Pat. No. 4,559,038, previously incorporated by reference. Pump 15 includes a pressure plate **15*a*, a tube 15*b*, a follower 15*c* and a cam shaft with a cam 15*d*. By rotating cam 15*d*, the reciprocally mounted follower 15*c* compresses tube 15*b* against pressure plate 15*a* at varying amounts during rotation of cam 15*d*** about a 360 degree span.

In prior art pump 15, fluid reservoir **15*e* supplies fluid to tube 15*b*. By appropriate movement of follower 15*c*, the fluid is pumped through tube 15*b*. Follower 15*c* can be a valve which opens and closes a fluid flow path through tube 15*b*. Follower 15*c* can instead be an expulsor which pushes on tube 15*b* to force fluid in the tube toward an open end of the tube, i.e. toward the patient. Prior art pump 15 is an example of a peristaltic pump which has three tube-engaging members. In prior art pump 15, three cams like cam 15*d*, and three followers like follower 15*c*** are provided. Operation of the three tube-engaging members in a peristaltic pump will be described in greater detail as they relate to the present invention.

Other peristaltic type pumps are known including a wave style peristaltic pump which includes a plurality of fingers which are reciprocally mounted. The fingers are reciprocally moved successively to engage and compress the tube in a wave pattern to pump fluid.

In prior art pump 15, the torque needed to rotate cam 15*d* is related to the force needed to compress tube 15*b* a predetermined amount. In general, the torque is related to: the tube properties during compression and expansion of tube 15*b;* the force applied to follower 15*c* by gasket 15*f;* the frictional forces applied by chassis 15*g* to follower 15*c;* and the frictional force applied by follower 15*c* to cam 15*b*. In general, the energy needed to rotate cam 15*d* a predetermined amount is related to the amount of rotation of cam 15*d* when the torque is applied.

Analysis of the torques and energies according to the present invention leads to an energy efficient design with an emphasis on increasing power supply life and an emphasis on reducing the peak torques. Such analysis is useful for ambulatory peristaltic pumps with replaceable or rechargeable power supplies.

Figure 2:
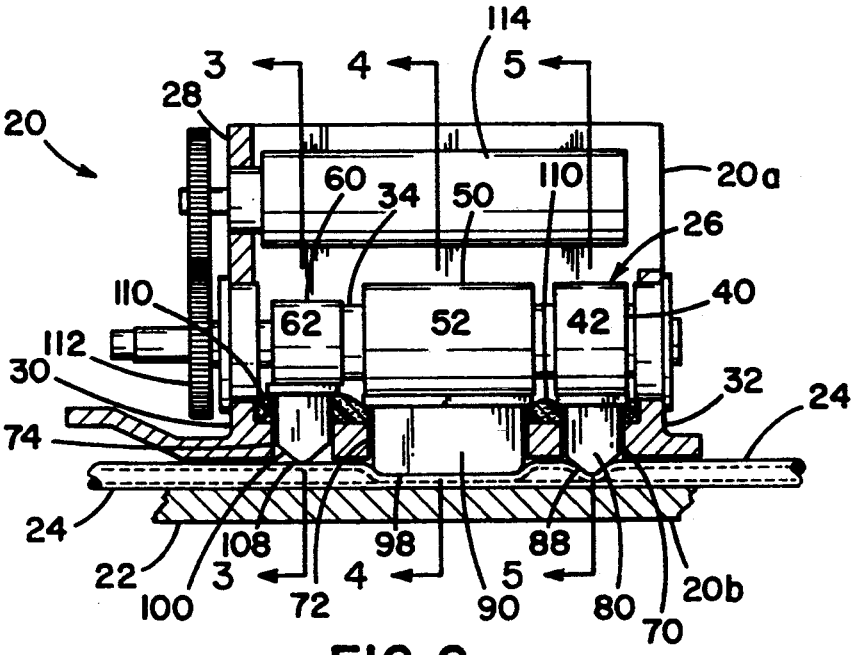
FIG. 2 is a partial front view of a pump apparatus according to the present invention.

Referring now to FIGS. 2 through 5, one preferred embodiment of a peristaltic pump apparatus, or pump 20 according to the present invention is shown. Pump 20 is particularly adapted for securement to a patient such as by a belt allowing the patient to be ambulatory while having continuous infusion of a drug at the desired rate. Pump 20 generally includes a control module 20*a*, and a reservoir module 20*b* selectively attachable to control module 20*a*. In FIG. 2, only a portion of the control module 20*a* and a portion of reservoir module 20*b* are shown.

Control module 20*a* generally includes a pumping mechanism 26 and associated control structure (not shown) for controlling pumping mechanism 26. A housing (not shown) is provided to enclose pumping mechanism 26 and the control structure. A keypad (not shown) may be provided to access the control structure. Reservoir module 20*b* generally includes a tube 24 and means for supplying fluid to the tube, such as the baglike reservoir 15*e* of FIG. 1, located at pump 20 or remotely to pump 20.

Referring now in particular to FIG. 2, pump 20 includes a pressure plate 22. Pressure plate 22 is generally associated with reservoir module 20*b* in one preferred embodiment. Positioned between pump mechanism 26 and pressure plate 22 is tube 24. Pump mechanism 26 interacts with tube 24 and pressure plate 22 to pump fluid through tube 24 at the appropriate rate. Pump mechanism 26 also restricts the free flow of fluid through tube 24 at all times.

Pump mechanism 26 includes a rotatable cam shaft 34. A chassis 28 with braces 30,32 is provided for rotatably holding cam shaft 34. Cam shaft 34 includes a first cam 40, a second cam 50, and a third cam 60.

Pump mechanism 26 further includes an inlet valve follower 80, an expulsor follower 90, and an outlet valve follower 100. Followers 80,90,100 are reciprocally mounted to chassis 28 through apertures 70,72,74, respectively. Each of the followers 80,90,100 is engageable with the respective cam 40,50,60 such that each follower is reciprocally movable in response to rotation of the respective cam.

Figure 5:
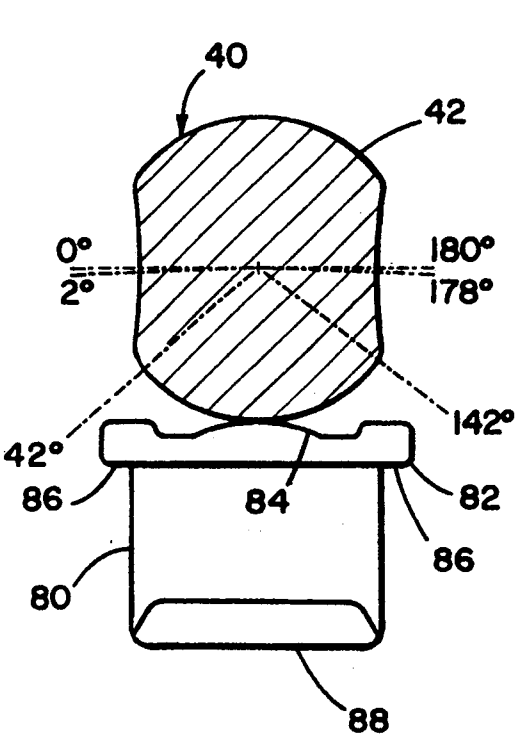
FIG. 5 is a partial cross-sectional end view of the cam shaft and inlet valve shown in FIG. 2 along line 5—5.

Referring now to FIGS. 2 and 5, inlet valve follower 80 includes a head portion 82 with an arcuate end 84 for engaging cam 40 along cam surface 42. Inlet valve follower 80 further includes an abutment surface 86 to maintain inlet valve follower 80 in aperture 70. Inlet valve follower 80 further includes a tip 88 for engaging tube 24 during reciprocal movement of inlet valve follower 80.

Figure 4:
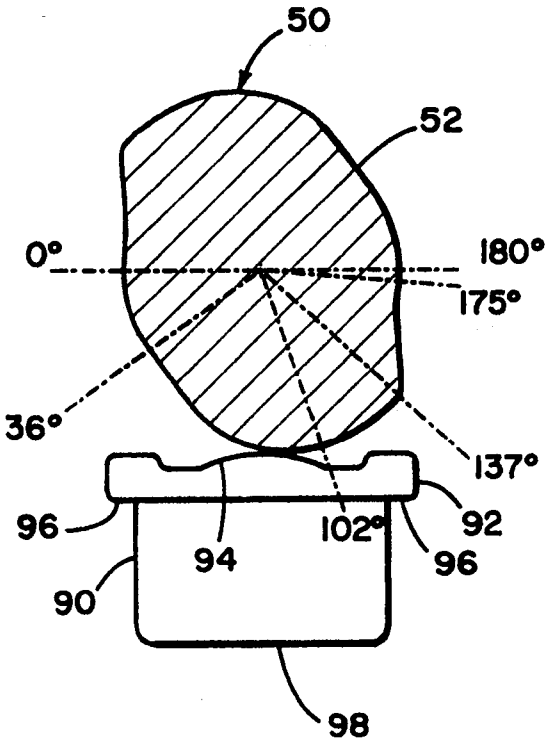
FIG. 4 is a partial cross-sectional end view of the cam shaft and expulsor shown in FIG. 2 along line 4—4.

Referring now to FIGS. 2 and 4, expulsor follower 90 includes a head portion 92 with an arcuate end 94 for engaging cam 50 along cam surface 52. Expulsor follower 90 further includes an abutment surface 96 to maintain expulsor follower 90 in aperture 72. Expulsor follower 90 further includes a surface 98, for engaging tube 24 during reciprocal movement of expulsor follower 90.

Figure 3:
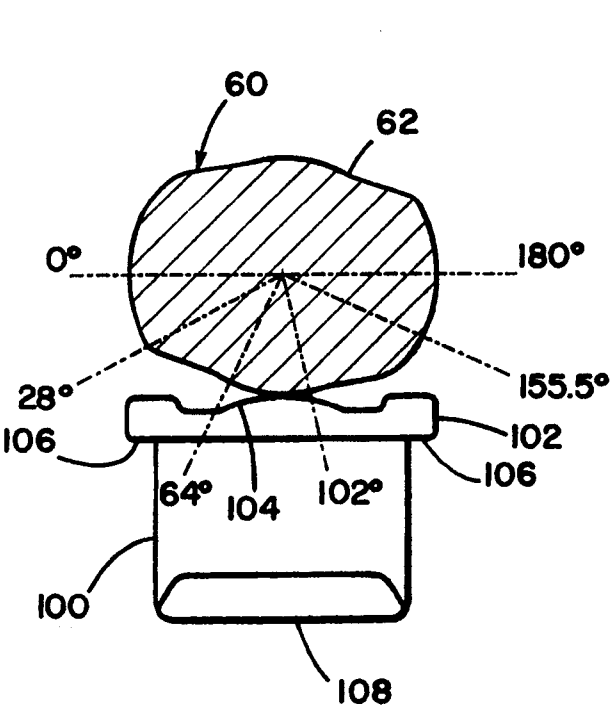
FIG. 3 is a partial cross-sectional end view of the cam shaft and outlet valve shown in FIG. 2 along line 3—3.

Referring now to FIGS. 2 and 3, outlet valve follower 100 includes a head portion 102 with an arcuate end 104 for engaging cam 60 along cam surface 62. Outlet valve follower 100 further includes an abutment surface 106 to maintain inlet valve follower 100 in aperture 74. Outlet valve follower 100 further includes a tip 108, for engaging tube 24 during reciprocal movement of outlet valve follower 100.

The following is an example of operation of the three followers 80,90,100 to pump fluid through tube 24. With outlet valve follower 100 compressing tube 24 closed, expulsor follower 90 and inlet valve follower 80 are positioned to allow tube 24 to fill with fluid from the fluid reservoir. Inlet valve follower 80 compresses tube 24 closed and outlet valve follower 100 permits tube 24 to open at least partially to permit the passage of fluid to the patient. Expulsor follower 90 compresses tube 24 to push the fluid past outlet valve follower 100 toward the patient. Outlet valve follower 100 then compresses tube 24 closed to begin the pumping cycle again.

A gasket 110 is provided for biasing expulsor follower 90 and inlet and outlet valve followers 80,100 toward cams 40,50,60 and for sealing followers 80,90,100 between pressure plate 22 and an interior of control module 20*a*. Gasket 110 includes appropriate apertures for receiving expulsor follower 90, inlet valve follower 80, and outlet valve follower 100.

Pump 20 includes means for turning gear 112, such as a motor and associated gearing 114. The motor can be a DC motor that rotates cam shaft 34 a predetermined amount to activate pumping mechanism 26. The motor is activated the predetermined number of times or the predetermined duration necessary to pump the desired amount of fluid to the patient.

In the preferred embodiment of the invention shown, chassis 28 includes means for attaching the pressure plate 22 to position tube 24 for engagement by expulsor follower 90, inlet valve follower 80, and outlet valve follower 100. As disclosed in U.S. Pat. No. 4,559,038, previously incorporated by reference, an upraised portion and hinge pins may be provided with respect to chassis 28. These are complementary to and for hingedly receiving hooked portions extending from pressure plate 22. At an opposite end of pressure plate 22, a lock member is provided for selectively mounting the second end of pressure plate 22 to chassis 28.

The power supply for the motor may include a replaceable battery, such as a conventional 9 volt battery. Suitable electronic controls are provided for operation of the motor for controlling the pumping of fluid from the fluid reservoir through tube 24 to the patient at the desired rate. In some cases, patient control of the motor may be provided.

The present pump 20 is operable at 60 revolutions per minute. Low speed mechanisms, such as pump 20, often use specified cam profiles such as simple eccentric, harmonic, or circular-arc came, because of the low dynamic effects and the ease manufacturing. In the case of compressing a tube in a direction transverse to the longitudinal axis of the tube, the tube force curve is nonlinear as the degree of compression changes. The simple eccentric, harmonic, Or circular-arc cams may not be energy efficient with respect to power supply life given that the tube load is nonlinear and that the structures of the cam/follower and follower/chassis interfaces can produce relatively high frictional loads. Also, peak torques may be unnecessarily high due to the nonlinear tube loading.

Systems and methods of cam and follower design and manufacture are provided to optimize the energy consumption of the peristaltic pumping mechanism 26 used in drug pump 20, and the pumping mechanisms of other pumps. The pumping mechanism of the pump 20 has been configured and arranged to minimize torques and energy consumption by analysis of the forces applied to the cam shaft 34, including a tube load which is nonlinear due to the shape of the tube and the manner the tube is compressed.

Ambulatory drug pumps frequently run on battery power, so total energy consumption and peak torque loads can be a significant concern. Numerous variables impact energy consumption and peak torque loads. The design and manufacturing techniques help facilitate the optimization of the cam profiles (cam surface shape) and the follower profiles (follower surface shape) to minimize both energy consumption and peak torque loads. At the center of the analysis is a calculation of the torques and the energy into and the energy out of the pumping mechanism.

A mathematical model is provided for analyzing the torques and energies for a given design. In the case of specified follower motion for use with a specified follower, the model calculates the resultant cam profile, and the cam radius of curvature. Optimization can then be done to determine optimal cam and follower profiles. In the case of a specified cam profile for use with a specified follower shape, the follower lift as a function of angular displacement is calculated for use in optimization.

Important inputs to the model include: the tube load as a function of tube deflection (including gasket load), the various coefficients of friction of the elements which slidably engage during operation, the various relevant dimensions of the follower and the chassis, the base circle radius of the cam, the amount of cam rotation for one activation, and either the follower lift motion as defined by an equation as a function of cam rotation, or a cam profile specified independently of the follower lift motion.

It has been found to be an advantageous step in the design process to specify a follower motion from which the cam profile can be computed. By specifying the follower motion initially, design optimization is facilitated. Setting the follower motion allows accommodation of the non-linear tube load applied to the cam during one activation. During optimization, the follower motion can be specified such that the follower is moved at a faster rate when the tube load is less, and such that the follower is moved at a slower rate when the tube load is higher. This helps minimize peak torques.

This model can be used to analyze an existing pumping mechanism, and then design a more energy efficient version, with only the cam profiles and follower profiles being changed. Other variables can be changed in the model to optimize the design. It is to be appreciated that in some optimizations of existing pumps, there may only be improvements in energy consumption or peak torques, but not both when the existing design is compared to the new optimized design. Alternatively, the model is useful for designing a new pump that meets or is within preselected ranges of desired energy consumption limits and peak torque limits.

The model computes the energy into the system by incrementally calculating the torque required to rotate the cam shaft a predetermined amount, typically one pumping activation. The integral of the torque verses cam angular position curve is the energy required to produce one pumping activation. The energy outputs are also calculated at the various locations of sliding frictional contact, as well as the hysteresis losses in the pump tube.

The tube loading input to the model is dependent upon the tube properties, for example, the size and composition of the tube, as well as the shape and the size of the tube engaging portion of the follower. For an existing pump, the force needed to compress the tube a predetermined amount with the tube engaging portion of the follower can be measured experimentally to develop the tube loading curve. Included in the tube loading curve is the force exerted by the gasket, like gasket 110 of FIG. 2, or other biasing structure which biases the follower away from the tube.

One cam and follower design and manufacturing method is provided wherein a follower motion is initially specified as a function of angular rotation of the cam. The shape of follower surface engaging the cam is also specified. The pressure angle at the contact region between the cam and follower is needed to calculate the resultant force acting on the cam. The pressure angle is solved for as a function of the angular rotation of the cam. The resultant force applied by the cam to the follower is solved for as a function of the angular rotation of the cam. Inputs to the resultant force equation include: the coefficient of friction of the cam and chassis interface, the shape of the cam engaging portion of the follower, the follower height, the follower width, the base circle radius of the cam, the amount of cam rotation for one activation, the chassis thickness, the distance from the center of the cam to the top of the chassis, and the tube load (including gasket load applied to the follower).

Once the resultant force is known as a function of angular displacement, the torque is calculated as a function of the angular displacement of the cam. An input to this analysis is the coefficient of friction for the cam and follower interface. A graph of torque versus angular displacement of the cam can be made to visually note magnitude and location of peak torque values. The area under the torque versus angular displacement curve is equal to an energy consumed value to rotate the cam a particular amount of angular displacement. If more than one cam is provided on the cam shaft, a graph of total torque applied to the cam shaft may be made to visually note the magnitude and location of the total peak torque values.

The separate energy components including the energy consumed by the frictional losses between the cam and follower and between the follower and the chassis can be calculated. Hysteresis losses can also be calculated with respect to the tube. When calculated, all of these energy components help the optimization process by isolating particular energy losses.

The optimization process proceeds by changing one or more variables to reduce one or both of the values obtained for energy consumption and peak torque loads. It has been found to be a useful technique to lower the energy consumption value as low as possible within preselected design constraints, and then reduce the peak torque value to the lowest possible value within the preselected design constraints. Once an optimized design is determined, the design parameters are utilized to manufacture an energy efficient pump including the optimized cam and follower design.

It is to be appreciated that the optimization process can be done experimentally such as by trial and error utilizing a computer where one or more selected variables are changed and then the computer outputs data regarding the peak torques and the energy consumed to rotate the cam. Alternatively, the optimization of selected variables can be done utilizing mathematical techniques, such as a Taguchi technique.

Figure 6:
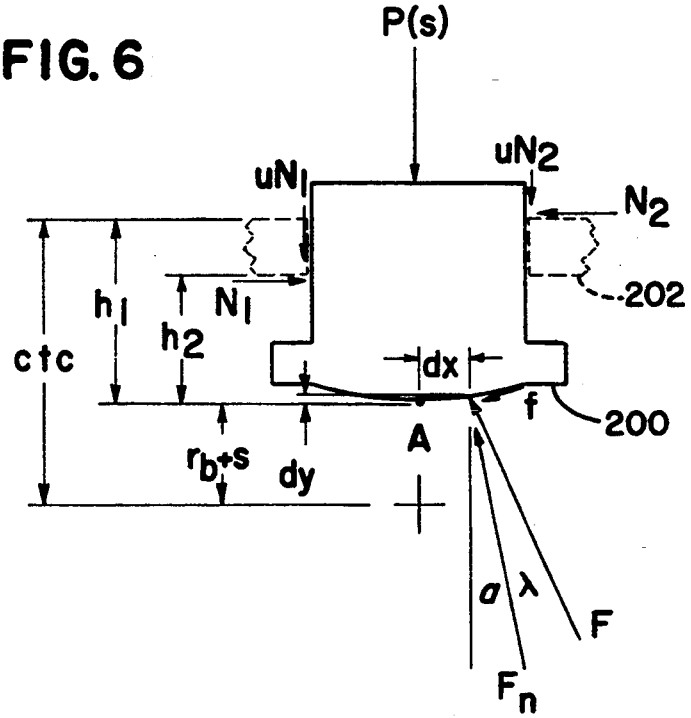
FIG. 6 is a free body diagram useful for solving for the resultant force applied by the cam to the follower in the energy and torque analysis.

The cam and follower design and manufacturing methods noted above will be discussed in greater detail. Referring now to FIG. 6, the basis of the model is the free body diagram of a follower 200, which can be used for the analysis of the input and output valve followers 90,100 and for the expulsor follower 80 for pump 20, or the cams and followers of other pumps with tube engaging members. The free body diagram analyzes the forces acting on the follower 200 including the resultant force F applied by the cam. The gravitational force has been omitted because it is several orders of magnitude less than the pump tube deflection force with respect to pump 20. For the same reason, the inertial force may be omitted unless the follower accelerations become much greater than 1 g. From the free body diagram:

$$\Sigma F_y = ma;\ F\cos\phi - \mu_f N_1 - \mu_f N_2 - P(s) = ma$$
$$\Sigma F_x = 0;\ N_1 - F\sin\phi - N_2 = 0$$

$$\Sigma M_A = 0;\ N_1 h_1 + \mu_f \frac{w}{2} N_2 - \mu_f \frac{w}{2} N_1 - N_2 h_2 - Fdx\cos\phi + Fdy\sin\phi = 0$$

The three planar equations of motion can be solved for the unknown force F, $$F = \frac{(P(s) + ma)(h_1 - h_2)/2\mu_f}{((h_1 - h_2)/2\mu_f - dx)\cos\phi + \left((h_1 + h_2)/2 + \mu_f \frac{w}{2} + dy\right)\sin\phi}$$

where, w=width of follower 200 ma=inertial load

P(s)=tube load $\phi=\lambda+\alpha$ (pressure angle plus friction angle)

$\mu_f$=follower 200 to chassis 202 coefficient of friction.

Force F is the resultant force of the normal force $F_n$ and the frictional force f. In order to solve this equation for resultant force F at incremental values of angular cam displacement, the follower lift, the follower acceleration and the pressure angle must first be known. The lift is used to solve for $h_1$ and $h_2$, and the pressure angle is used to solve for dx and dy, $$dx = r_f \sin\alpha$$

$$dy = r_f(1-\cos\alpha)$$

where, $r_f$=radius of follower 200.

The values of $h_1$ and $h_2$ depend on the direction and location of resultant force F. Whichever way the follower tends to rotate will have the lower h value, and this depends on whether $\phi$ (combined pressure and friction angle) is greater or less than arctan (dx/(ht−dy), where, $$h_1 = ctc - cth - r_b - s,\ \text{if } \phi > \arctan(dx/(ht-dy)),\ \text{else}\ h_1 = ctc - r_b - s$$

$$h_2 = ctc - r_b - s,\ \text{if } \phi > \arctan(dx/(ht-dy)),\ \text{else}\ h_2 = ctc - cth - r_b - s$$

where, ctc=total height from center of cam to top of chassis 202 cth=chassis thickness of chassis 202

$r_b$=base circle radius of cam 204 s=lift of follower 200 ht=height of follower 200.

This model assumes that the combined loading of the pump tube and gasket for pump 20 can be applied at the center of the follower. This is not a significant problem as long as the follower does not rotate about the z-axis because of the small gap between the follower 200 and the chassis 202. Any rotation will cause an additional torque about the z-axis because of the differential compression of the tube and foam pad. Any rotation of the follower would tend to reduce the magnitude of the side reaction forces $N_1$ and $N_2$. The model also assumes point contacts, and no deformation of the follower.

One of the primary design concerns is minimizing the required cam shaft input torque for a specified follower motion. Minimizing contact forces to minimize wear is also a main concern. High contact forces lead to high input torques. The input torque is affected by the pressure angle on the cam and the inertial loading from high accelerations and large follower masses. The pressure angle is the angle between the direction of follower motion and the normal to the contact between the cam and the follower. The pressure angle is in effect a measure of the mechanical advantage of the system.

Follower motion optimization is a balance between minimizing accelerations and minimizing pressure angles. For example, if the acceleration is minimized at the start of the lift motion, the velocity must increase slowly, and therefore must reach a higher maximum somewhere during the lift, to achieve the same total lift over the same duration. This raises the pressure angle at some point during cam rotation. The lowest possible velocity and pressure angle would be achieved with a constant velocity of $L/\beta$, (where L is total follower lift, and $\beta$ is total angular duration), but the initial and final accelerations would be infinite. In pump 20, the rotational masses are approximately one gram, so the inertial loading is very low. If the rotational speeds and follower masses were greater, then the accelerations would have to be further minimized at the expense of higher maximum pressure angles. The cam and follower design can be optimized by analyzing the impact of the pressure angle of the energies and torques.

To control pressure angles, a polynomial curve of follower motion is provided that permits setting the velocity at the start and finish of the lift curve as well as setting the maximum velocity at any specified point during the lift. This allows tailoring the follower lift curve to the nonlinear tube loading so that during low loads the velocity is high, and later during high loads the velocity and pressure angle are minimized.

Non-zero initial and final velocities would cause infinite accelerations and should probably be avoided. However, the followers are probably compliant enough to tolerate infinite acceleration spikes, so this option was included in the model.

The polynomial follower lift curve can be calculated in a normalized reference system where total lift and angular duration are 1. The polynomial is formed by using the following boundary conditions:

$$\text{at } \theta = 0, \text{ velocity} = Vo$$
$$\text{lift} = 0$$

$$\text{at } \theta = K, \text{ velocity} = V\max$$
$$\text{acceleration} = 0$$

$$\text{at } \theta = 1, \text{ velocity} = Vf$$
$$\text{lift} = 1$$

By substituting these conditions into the following equation for lift s, a system of equations can be formed and solved for the unknown coefficients $a_0$ to $a_5$.

$$s=a_0+a_1\Theta+a_2\Theta^2+a_3\Theta^3+a_4\Theta^4+a_5\Theta^5$$

The cam and follower modeling program can be set up to solve this system of equations, using the above variables Vo, Vf, K, and Vmax, so that by simply changing these variables new motion polynomial curves can be generated. These motions can be then input into the model to determine the effect on mechanism forces, torques, and energies.

In the design optimization, the pressure angles and cam profiles are determined for the specified follower motion. Determining the pressure angle $\alpha$ depends on whether the follower motion is specified, or in the less common instance if the cam profile itself is specified.

Figure 7:
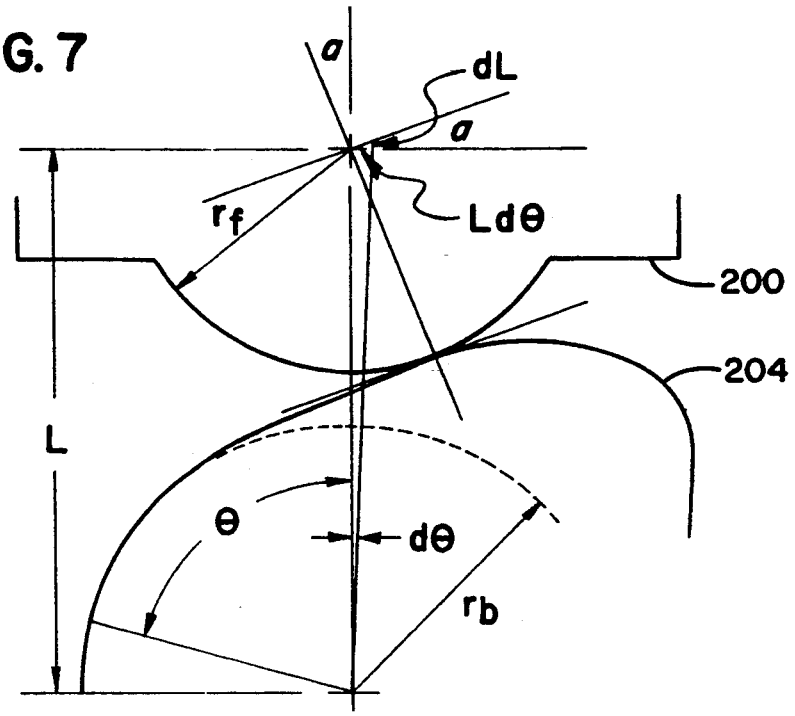
FIG. 7 is a diagram useful for computing the resultant force when the follower motion is initially specified.

First, the case where the follower motion is specified will be discussed. This case is comparable to what may be described as a translating roller follower, except there is sliding friction on the non-rolling "roller" geometry of the follower 200. In FIG. 7 it can be seen that:

$$L=r_b+s+r_f$$

where s=follower 200 motion $$\tan\alpha = \frac{dL}{Ld\theta}$$

$$\frac{dL}{d\theta} = \frac{ds}{d\theta}$$

therefore, $$\alpha = \arctan\frac{ds}{Ld\theta}$$

With the pressure angle known, the cam profile is computed as follows:

$$R_x=(r_b+r_f+s)\cos\Theta-r_f\cos(\alpha-\Theta)$$

$$R_y=(r_b+r_f+s)\sin\Theta-r_f\sin(\alpha-\Theta)$$

Figure 8:
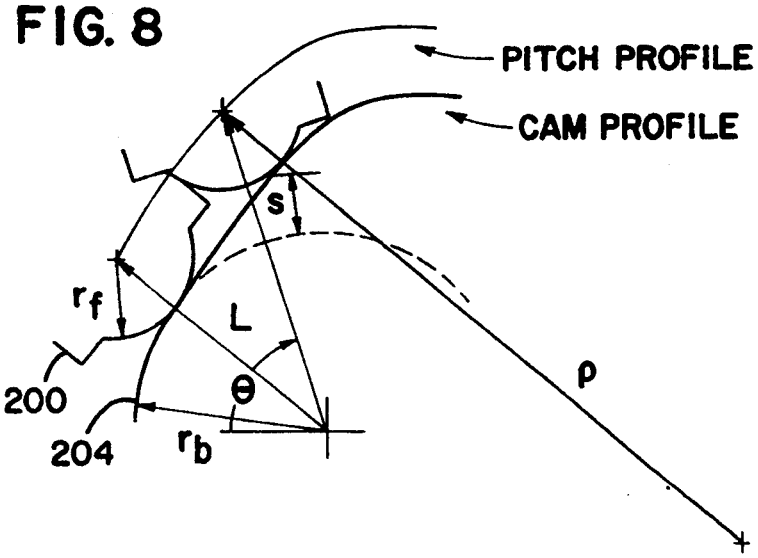
FIG. 8 is a diagram useful for computing the cam profile when the follower motion is initially specified.

The radius of curvature of the pitch curve as shown in FIG. 8 is, $$P_{pitch\ curve} = \frac{\left[L^2+\left(\frac{ds}{d\theta}\right)^2\right]^{\frac{3}{2}}}{L^2+2\left(\frac{ds}{d\theta}\right)^2-L\frac{d^2s}{d\theta^2}}$$

and, $P_{cam\ profile} = P_{pitch\ curve} - r_f$, where $L = r_b + r_f + s$

Figure 9:
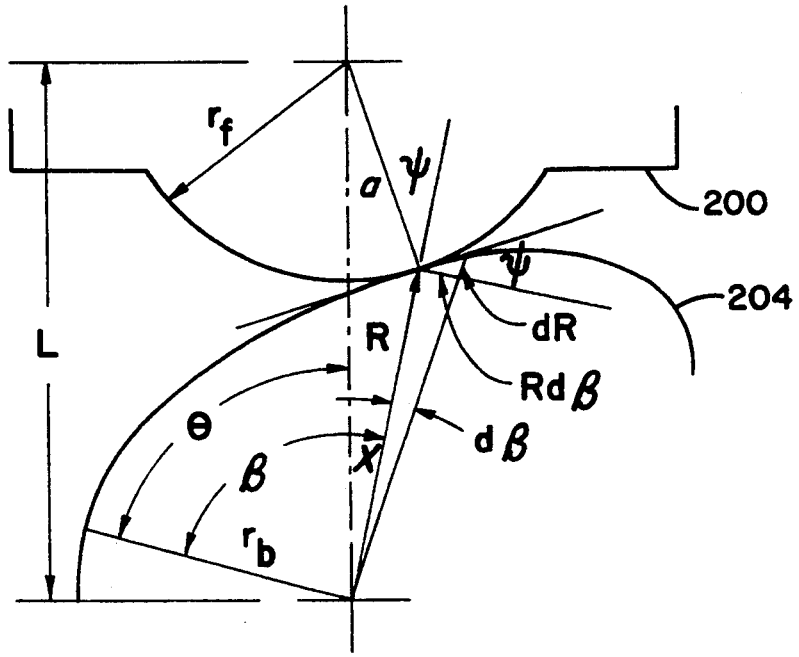
FIG. 9 is a diagram useful for computing the resultant force when the cam profile is initially specified.

For the case where the cam profile is initially specified, the pressure angle and follower lift must be determined. The distance R for the cam profile is known as a function of some angle $\beta$, and it is desired to know the follower lift s and pressure angle $\alpha$, both as a function of $\Theta$. Referring to FIG. 9:

$$R=r_b+s',$$

where s' as a function of $\beta$ is defined for the cam profile $$\tan\psi = \frac{ds'}{Rd\beta}$$

From Law of Cosines, $$L^2=R^2+r_f-2Rr_f\cos(\pi-\psi)$$

where $\pi$=pi

From Law of Sines, $$\alpha = \arcsin\left(\frac{R}{L}\sin(\pi-\psi)\right)$$

Lift of follower $s=L-r_b-r_f$ $$\chi=\pi-\alpha-(\pi-\psi)=\psi-\alpha$$

and, $\Theta=\beta-\chi$.

If the cam radius of curvature is less than $r_f$, then the follower will not always track the cam (undercutting). If this occurs, s will be negative, and should therefore be set to equal $r_b$, until s becomes positive.

If an energy balance is done on the mechanism, then $E_{in}=E_{out}$ where:

$$E_{in}=\int T d\Theta$$

$$E_{out}=\int\mu_c F_n ds+\int\mu_f N_1 ds+\int\mu_f N_2 ds+\int P(s)ds.$$

Figure 10:
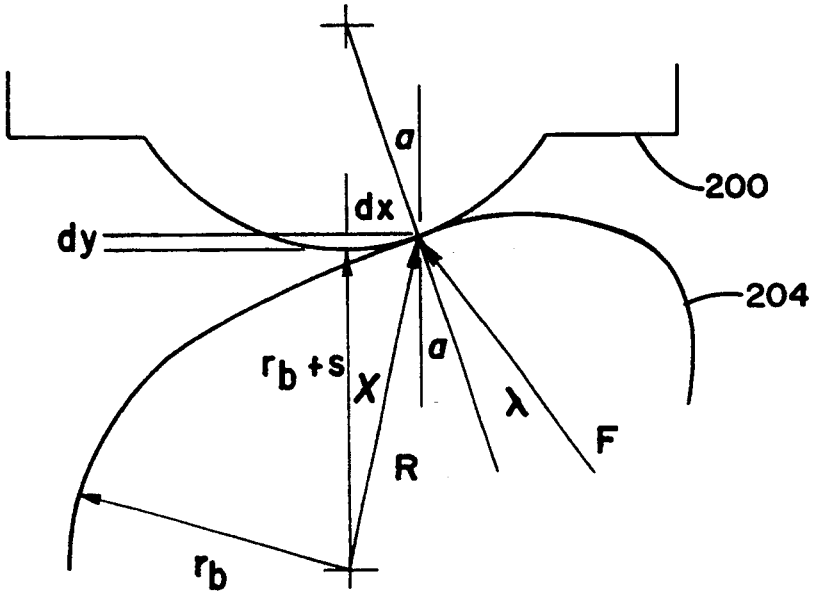
FIG. 10 is a diagram useful for computing the torques applied to the cam when the follower motion is initially specified.

To calculate the $E_{in}$ term it is necessary to find the input torque for either specified follower motion, or specified cam profile. Referring to FIG. 10 for specified follower motion:

$$\lambda=\arctan\mu_c$$

where, $\mu_c$ is the coefficient of friction between the cam and the follower, and $$R = \sqrt{dx^2 + (r_b + s)^2}$$

$$\chi = \arctan\left(\frac{dx}{r_b + s}\right)$$

$$T = RF\sin(\lambda + \alpha + \chi).$$

Figure 11:
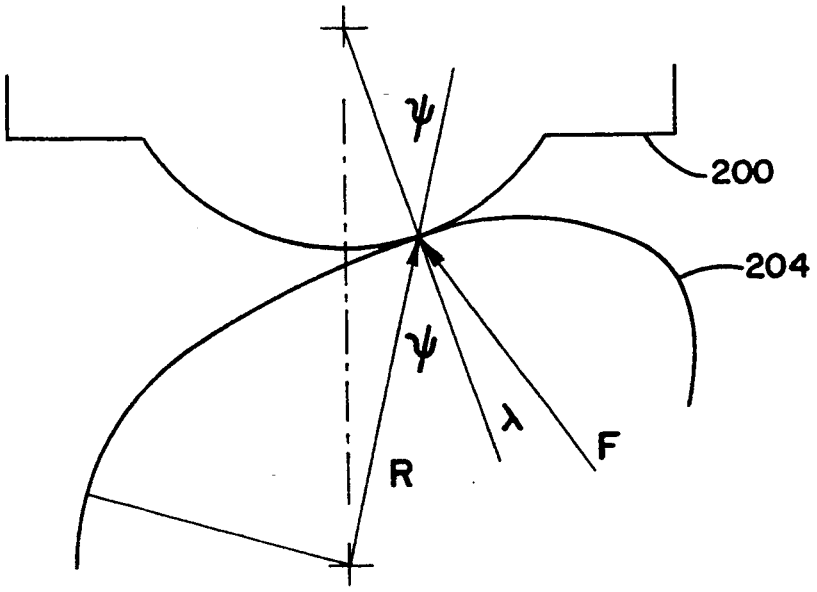
FIG. 11 is a drawing useful for computing the torques applied to the cam when the cam profile is initially specified.

Referring to FIG. 11 for specified cam profile:

$$\lambda = \arctan \mu_c$$

$$R = r_b + s'$$

$$T = RF\sin(\psi + \lambda).$$

The $E_{out}$ terms can be evaluated as follows, using trapezoidal integration techniques to compute the individual energy loss components:

(1) the energy due to cam/follower friction:

$$\int \mu_c F_n ds \cong \sum_{i=0}^{n-1} \mu_c F_n \Delta S, \; n = \text{no. of angular increments}$$

where,
$F_n = (F_{ni} + F_{ni+1})/2$
and, $$\Delta S = \sqrt{(R_{xi+1} - R_{xi})^2 + (R_{yi+1} - R_{yi})^2} + a\sqrt{(\delta_{xi+1} - \delta_{xi})^2 (\delta_{yi+1} - \delta_{yi})^2}$$

and $$a = \begin{cases} 1 \text{ when } \delta_{xi+1} < \delta_{xi} \\ -1 \text{ when } \delta_{xi+1} > \delta_{xi} \end{cases}$$

The first term for $\Delta S$ is the distance traversed on the cam profile, and the second term for $\Delta S$ is the corresponding distance traversed on the follower surface.

(2) the energy due to follower/chassis friction:

$$\int \mu_f N_{1,2} ds \cong \sum_{i=0}^{n-1} \mu_f N_{1,2} \Delta s$$

where,
$N = (N_i + N_{i+1})/2$
and, $\Delta s = s_{i+1} - s_i$ (3) the energy due to tube losses:

$$\int P(s) ds \cong \sum_{i=0}^{n-1} P(s) \Delta s$$

where,
$P = (P_i + P_{i+1})/2$
and, $\Delta s = s_{i+1} - s_i$

The coefficients of friction can be experimentally determined, if not known, by using a force gauge to pull a weighted specimen of follower material across both chassis material and cam material.

Tube loading P(s) can be determined experimentally in an existing pump, like pump 15, by measuring the forces necessary to lift the inlet and outlet valves and the expulsor to various heights. This can be accomplished by drilling small holes through the cam shaft of prior art pump 15 at the valves and expulsor locations. Free fitting pins can be installed along with set screws to lock the pins in any position. The cam is then reassembled in a chassis which is then latched to a reservoir module with a pressure plate. The pins are pushed through the cam with a force gauge and locked, after which the reservoir module is removed and the valve or expulsor heights measured. This is repeated at various increments. The forces can also be measured as the tube is unloaded, to give an indication of any hysteresis effects. Polynomials can then be curve fit to the data and then used in the model for the tube load P(s).

The cam and follower design optimization and modeling can be performed using Microsoft Excel software. Using Excel software allows fairly fast running and re-plotting of torque graphs and cam profiles, as lift motions and cam and follower dimensions are changed. Other high level programming languages, such as Fortran or Basic could be utilized to optimize the design.

When a new design is optimized, cam profile x-y coordinate data files can be generated using Basic, and these data files can be used to drive CNC cam grinding equipment to manufacture the cam of the optimized design and/or materials. The follower design can be manufactured from a variety of materials and processes with the optimized dimensions and/or materials.

Energy losses can be minimized by reducing the $\int \mu_c F_n ds$ and $\int \mu_f N ds$ energy terms, which are the cam contact and follower side load frictional energy losses, respectively. The $\int P(s) ds$ hysteresis losses are essentially constant for a given pump tube.

One method of design optimization is to vary the follower shape to reduce frictional loads applied to the follower by the chassis until an optimal design is achieved. The side load frictional losses can be minimized by providing a radius of curvature on the "roller" section of the follower 200 which is convex as shown in FIG. 7, for example, instead of concave as shown in prior art pump 15. If the cam contact force F is directed toward the center of the pump tube contact area, then high side loads from chassis 202 are not present to prevent rotation of the follower 200. If the force F is away from the pump tube, then the side loads and frictional losses will be higher. The arcuate portion 84,94,104 of each follower 80,90,100 is preferably a convex radius.

A further method of design optimization is to vary the base circle radius of the cam and/or the amount of cam rotation for one activation until an optimal design is achieved. The cam contact frictional losses can be minimized by reducing the distance traveled on the cam, for a given $\mu_c$. This is possible by either reducing the base circle radius or the overall amount of cam rotation required for one pumping activation. The differential ds part of the $\int \mu_c F_n ds$ term is equivalent to $rd\Theta$, so the distance can be reduced by reducing either the radius r or the angular duration $d\Theta$. As the base circle radius is reduced, however, the pressure angle will increase, so for a given maximum pressure angle (usually 30 deg) there is a minimum base circle radius.

Peak torques can be controlled by changing the lift duration, and lift motion. For a given lift duration and the preferred tube 24, the peak torques can be minimized by appropriate setting of the maximum lift velocity. The initial and final velocities can be left equal to zero.

The present invention relates particularly to a method of design optimization and manufacturing of a cam and a follower for a peristaltic pump having a compressible tube, where the method comprises the steps of: selecting a cam and follower design $D_n$ including the parameters needed to calculate torques and energies applied to the cam to move the follower; and obtaining a tube force loading curve indicative of the force applied to the tube which is necessary to compress the tube with the cam and follower design $D_n$. The tube force loading curve may change as the tube properties change and/or the shape of the follower surface engaging the tube changes. If those features remain constant in the design optimization, then this data need only be measured or obtained once. The method further includes computing a torque curve or torque data to permit identification of a peak torque value and an energy consumed value for the cam and follower design $D_n$. The peak torque value and the energy consumed value for the cam and follower design $D_n$ are optimized by varying one or more of the following parameters: the follower shape, the amount of cam rotation for one activation, the follower motion, and the cam base circle radius for a different cam and follower design $D_{n+1}$. Still other parameters affecting peak torques and energies can be changed to optimize the design. The optimization proceeds with still further different cam and follower designs $D_{n+2}$, etc. Once the peak torque value and the energy consumed value for the selected cam and follower design $D_n$, $D_{n+1}$, or $D_{n+2}$, etc. are both acceptable, then a cam and a follower are manufactured with the optimized cam and follower design parameters. The above method is useful for simultaneously analyzing a plurality of cams on a single cam shaft and a plurality of followers, as in a peristaltic pump having an expulsor and inlet and outlet valves.

The present invention also relates particularly to a method of design optimization and manufacturing of a cam and a follower for a pump having a compressible tube to improve the performance of an existing pump, where the method comprises the steps of: obtaining an energy consumed value for one activation of the existing pump; and obtaining torque data during one activation of the existing pump. This can be done experimentally by measuring peak power demand and power supply life. Power usage can be measured with an oscilloscope. The method further comprises selecting a new cam and follower design $D_n$ for the pump. A tube force loading curve indicative of the force applied to the tube which is necessary to compress the tube with the cam and follower design $D_n$ is measured or obtained. Again, the tube force loading curve may vary if the tube properties are changed or if the shape of the follower surface engaging the tube is changed. Torque data indicative of the torques applied to the cam to move the follower through the follower motion using the tube force loading curve is calculated. The energy consumed to rotate the cam to move the follower design through the follower motion using the tube force loading curve is calculated. The torque data and the energy consumed for the cam and follower design $D_n$ is compared to the torque data and the energy consumed value for the existing pump. The cam and follower design $D_n$ is optimized by selecting different new cam and follower designs $D_{n+1}$, $D_{n+2}$, etc. Once optimized, a cam and a follower is manufactured using the optimized cam and follower design parameters.

The following is an example of the results of a design optimization for optimizing the cam and follower design of a pump like prior art pump 15 to result in pump 20 having an expulsor 90, and inlet and outlet valves 80,100:

Radius of all of the arcuate ends 84,94,104 of followers 80,90,100: 0.25 inches.

Length of arcuate ends 84,104 of followers 80,100: 0.367 inches.

Length of arcuate end 94 of follower 90: 0.796 inches.

Dimensions of tips 88,108 of followers 80,100: a dimension of 0.434 inches in the transverse direction relative to tube 24, with radiused ends of 0.031 inches, and each tip being formed by planar surfaces each at 40 degrees to the horizontal and interconnected by a curved radial surface of 0.047 inches.

Dimensions of surface 98 of follower 90: a generally planar surface of 0.657 inches in the direction of tube 24 and 0.434 inches in the transverse direction relative to tube 24, with radiused corners of 0.093 inches.

Figure 12:
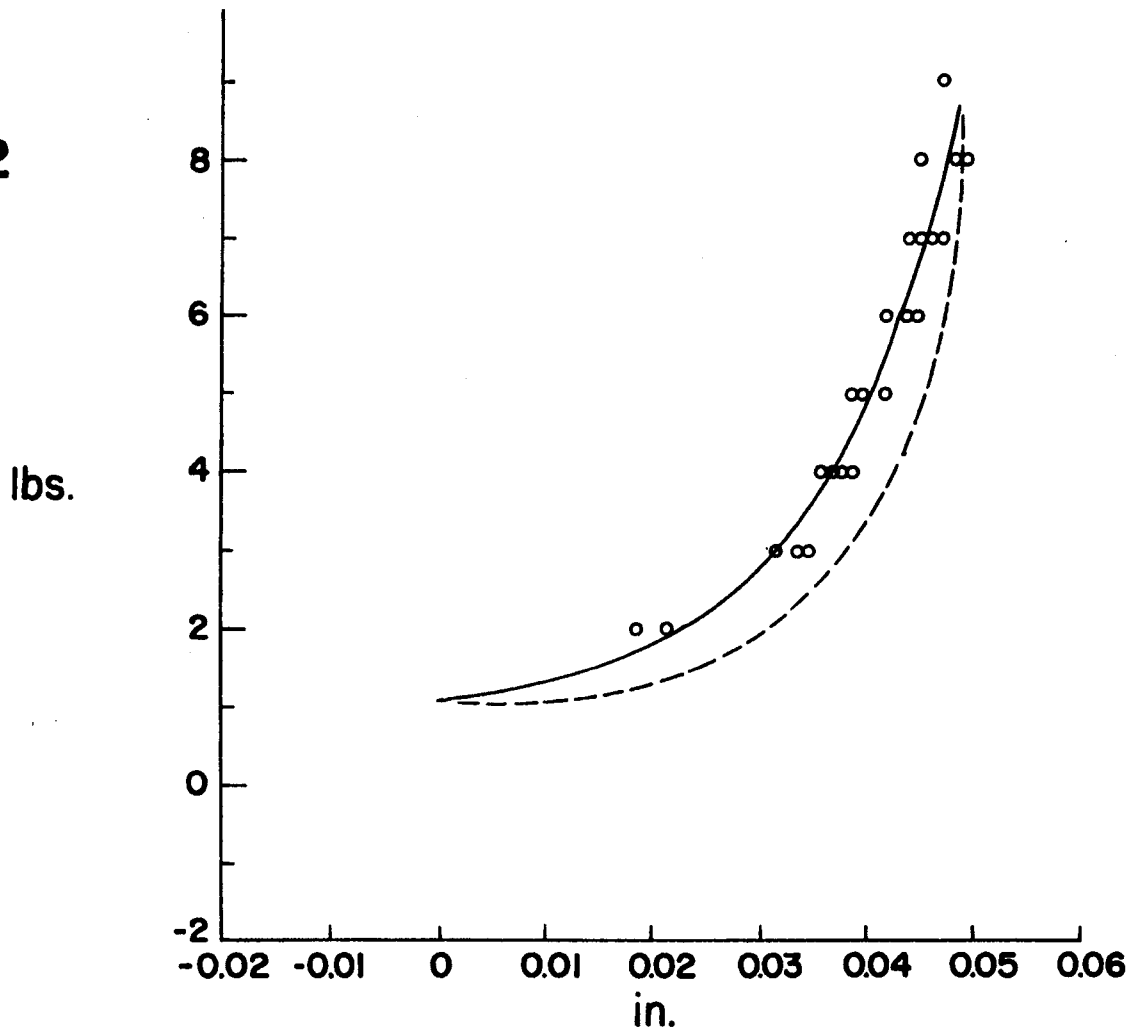
FIG. 12 is an example of one tube loading curve illustrating the tube loading necessary to compress the tube to a more compressed state in solid line, and the tube loading when the tube returns from the compressed state to a less compressed state in the dashed line.

Tube 24 has the following properties:

tube outside diameter: 0.164 inches tube wall thickness: 0.032 inches material: PVC The tube loading curve was experimentally measured by repeating the pin process described above at 0.5 lb increments and resulting in data like that shown in FIG. 12 for the expulsor of an existing pump, a CADD-1 TM pump, with 50 microliters per activation, by Pharmacia Deltec, of St. Paul, Minn.

Tube load equation for inlet/outlet valves, curve fit from measured data: Force to compress tube and gasket approximately $=1.053+28.678s+1.1729e6s^4$ Tube load equation for expulsor, curve fit from measured data: Force to compress tube and gasket approximately $=1.384+59.457s+76637s^4$ Gasket 110 is made from a closed cell urethane foam approximately 0.18 in thick.

A measured coefficient of friction between the followers 80,90,100 (acetal) and the chassis 28 (aluminum): approximately 0.08.

A measured coefficient of friction between the cams 40,50,60 (stainless steel) and the followers 80,90,100: approximately 0.06. This includes an oil film (motor oil) between the surfaces.

Pump power supply: 1–9 volt battery.

The maximum lift velocity was set to approximately 1.6 $L/\beta$ at 0.25 $\beta$ for the expulsor. The maximum lift velocity was set to approximately 1.8 $L/\beta$ at 0.25 $\beta$ for the inlet valve. The maximum lift velocity was set to approximately 1.9 $L/\beta$ at 0.23 $\beta$ for the outlet valve. The maximum fall velocity was set to approximately 1.6 $L/\beta$ at 0.3 $\beta$ for the expulsor and the inlet and outlet valves.

Inlet and outlet valve/expulsor follower height (ht): 0.3375 in.

Inlet and outlet valve/expulsor follower width (w): 0.365 in.

Cam shaft axis to top of chassis 28 distance (ctc): 0.5 in.

Chassis 28 thickness (cth): 0.100 in.

Cam surfaces 42,52,62:

TABLE 1

| INLET VALVE CAM PROFILE | | | |
|---|---|---|---|
| Motion | Radius in inches | Angle of rotation $\theta$ | |
| Dwell | .165 | 0°–2° | & ADD 180° |
| Rise | Poly-curve | 2°–42° | |
| Dwell | .213 | 42°–142° | |
| Fall | Poly-curve | 142°–178° | |
| Dwell | .165 | 178°–180° | |

TABLE 2

| EXPULSOR CAM PROFILE | | | |
|---|---|---|---|
| Motion | R | θ | |
| Dwell | .165 | 0°–36° | & ADD 180° |
| Rise | Poly-curve | 36°–109° | |
| Dwell | .2275 | 109°–137° | |
| Fall | Poly-curve | 137°–175° | |
| Dwell | .165 | 175°–180° | |

TABLE 3

| OUTLET VALVE CAM PROFILE | | | |
|---|---|---|---|
| Motion | R | θ | |
| Dwell | .213 | 0°–28° | & ADD 180° |
| Fall | Poly-curve | 28°–64° | |
| Dwell | .165 | 64°–102.5° | |
| Rise | Poly-curve | 102.5°–155.5° | |
| Dwell | .213 | 155.5°–180° | |

Figure 13:
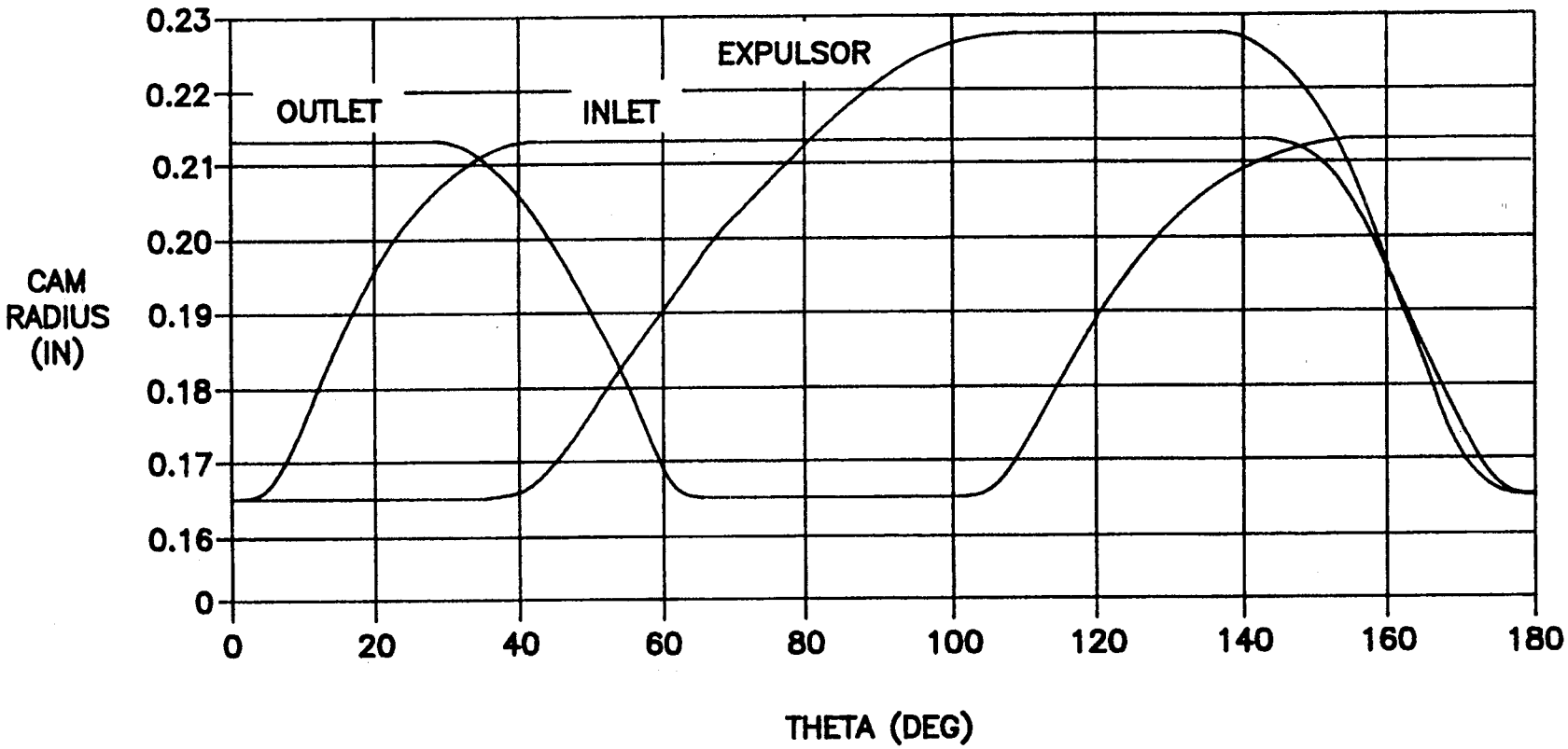
FIG. 13 is an example of the cam profiles for an inlet valve cam, an expulsor cam, and an outlet valve cam resulting from a cam and follower design optimization for a pump.
Figure 14:
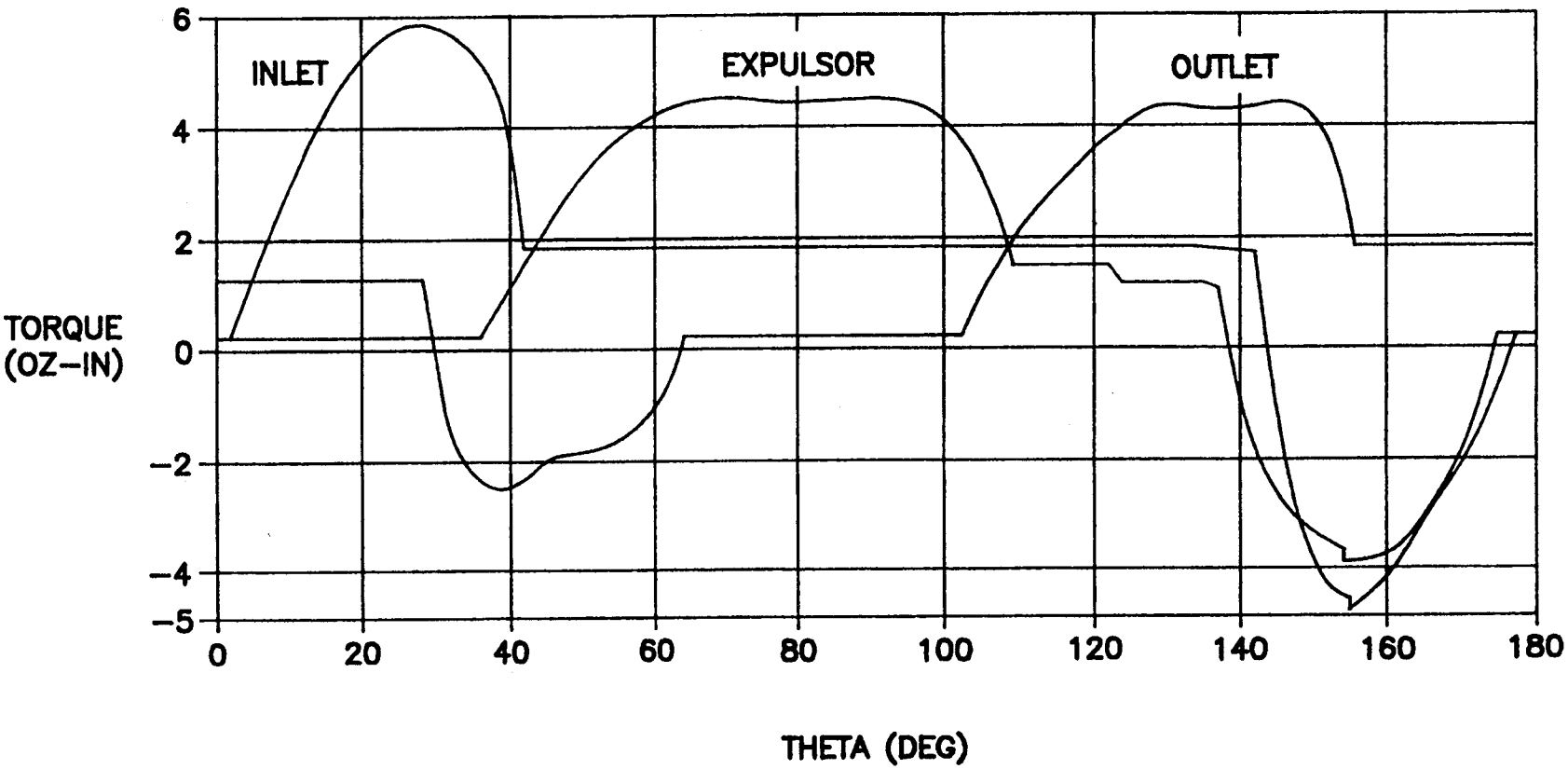
FIG. 14 is an example of the torques applied to each of the inlet valve cam, the expulsor cam, and the outlet valve cam of FIG. 13 during one activation of the pump.
Figure 15:
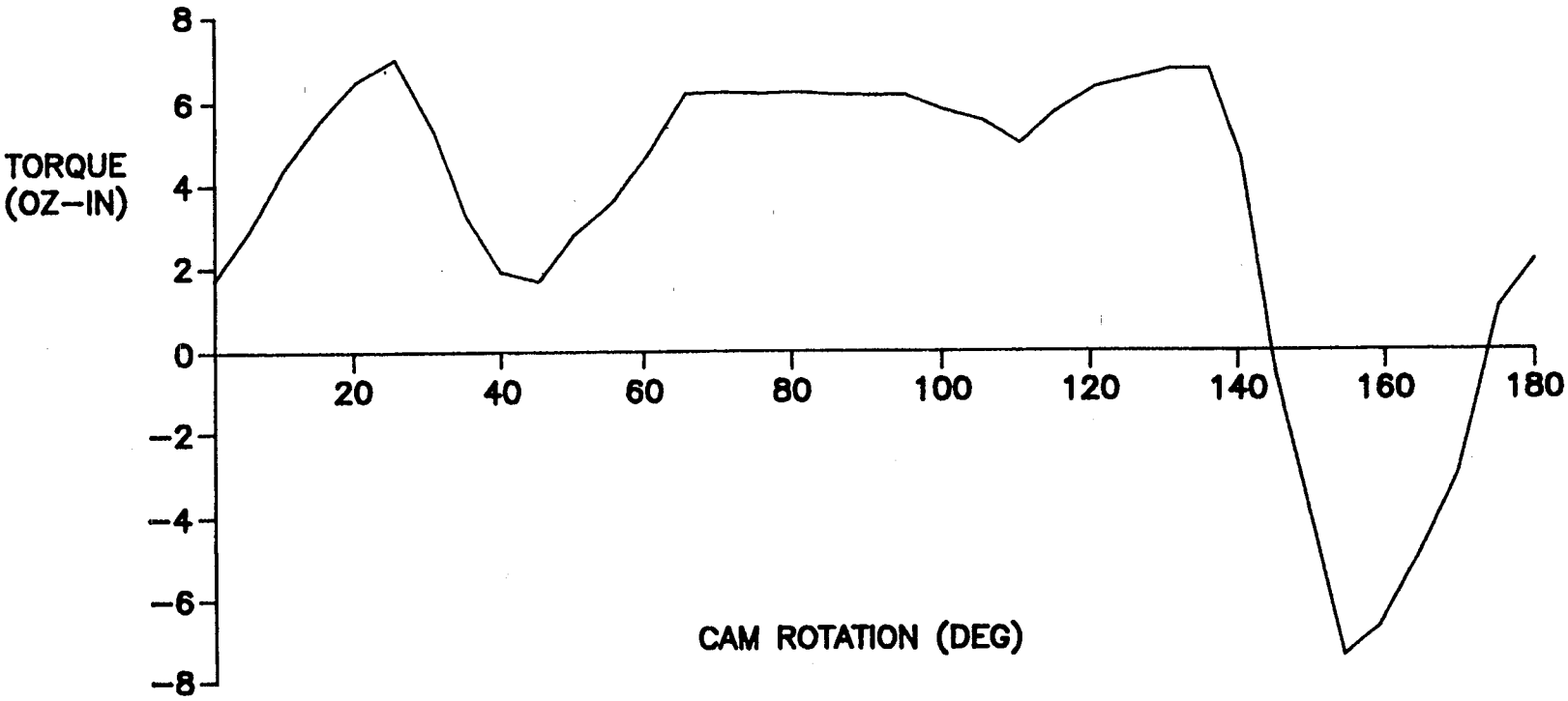
FIG. 15 is an example of the total torques applied to the cam shaft including the inlet valve cam, the expulsor cam, and the outlet valve cam of FIG. 13 during one activation of the pump.

FIG. 13 shows a graph of the cam profiles for cam surfaces 42,52,62. FIG. 14 shows a graph of the torques applied to each cam turning one activation of pump 20. FIG. 15 shows a graph of the total torque applied to all three cams during one activation of pump 20.

The methods can be employed to optimize the new mechanism design over the prior design shown in FIG. 1. In the present example, the follower profile was changed from concave to convex to lower the side load energy losses by making the follower radius as large as possible without causing undercutting. The follower motion was designed to reduce peak torques by moving the maximum velocity location. The cam-follower contact losses were reduced by completing an activation in 180 degrees. The base circle radius was reduced. To facilitate using the same chassis and gasket, the inlet and outlet valve followers and the expulsor follower were lengthened. The new more energy efficient cam and follower design of pump 20 only requires different cam and follower profiles over prior art pump 15, so the tube, the foam pad, the chassis dimensions, and the coefficients of friction all remain the same. The new energy efficient mechanism completes an activation in 180 degrees, rather than 360 degrees, with essentially the same peak torques. The energy consumption is reduced by approximately 50% and volumes delivered were almost doubled (approximately 1700 ml per 9 volt battery for pump 20, and approximately 900 ml per 9 volt battery for pump 15).

The present invention may also be particularly useful to create a new pump design which meets or is below predetermined peak torques and energy consumed values. A method of manufacturing a cam and a follower for a peristaltic pump having a compressible tube is provided wherein the method comprises the steps of: selecting an initial cam and follower design $D_n$; obtaining tube force data indicative of the force applied to the tube which is necessary to compress the tube with the cam and follower design $D_n$; calculating torque data indicative of the torques applied to the cam; calculating the energy consumed to rotate the cam; comparing the torque data and the energy consumed for the cam and follower design $D_n$ to desired torque data and a desired energy consumed value; if the torque data and the energy consumed for the cam and follower design $D_n$ is not lower than or within a preselected range (set by the user) of the desired torque data and the desired energy consumed value, then selecting one or more different cam and follower designs $D_{n+1}$, $D_{n+2}$, etc., and calculating torque data and an energy consumed value for the cam and follower design $D_{n+1}$, $D_{n+2}$, etc., until such torque data and energy consumed value is acceptable; and then, once the torque data and the energy consumed for the cam and follower design $D_n$, $D_{n+1}$, $D_{n+2}$, etc., is lower than or within the preselected range of the desired torque data and the desired energy consumed value, manufacturing a cam and a follower having the optimized cam and follower design $D_n$, $D_{n+1}$, $D_{n+2}$, etc. The optimization of the cam and follower design Dn includes optimization of preselected parameters such as follower shape, follower motion, cam base circle radius, and cam rotation for one activation, and other parameters. The method may further comprise the optimization of the design and manufacture of a cam and follower design including a plurality of cams and followers.

Figure 16:
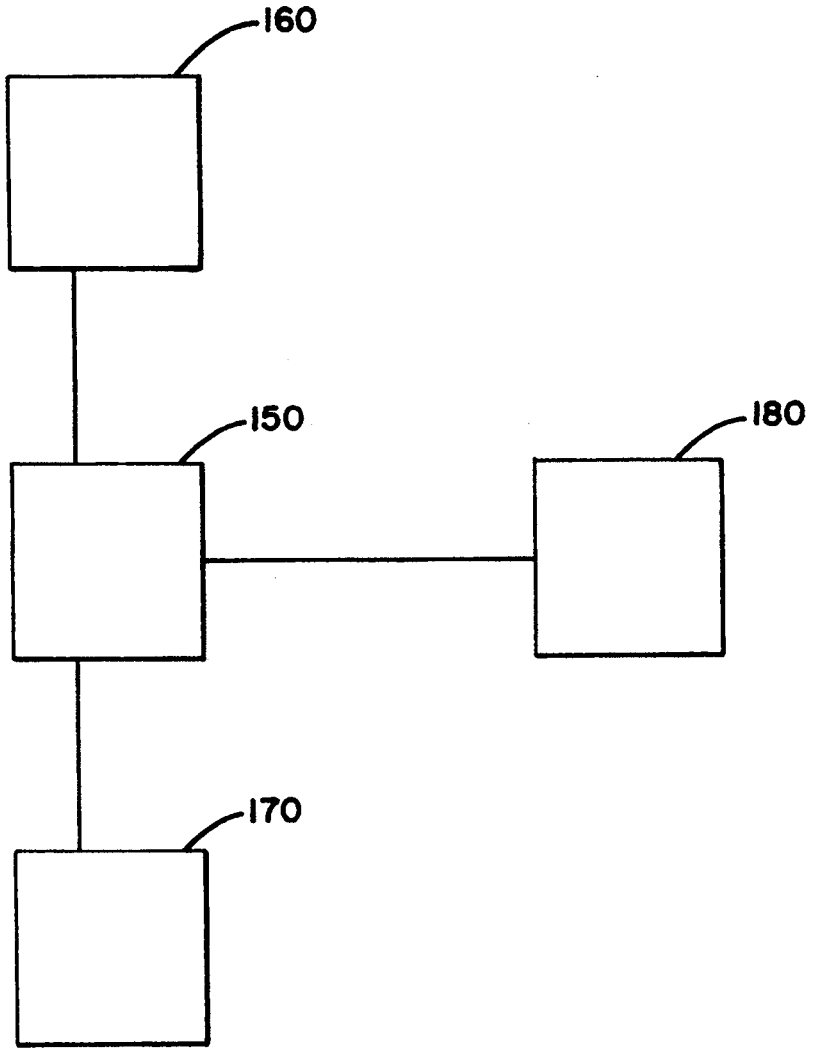
FIG. 16 is a schematic diagram of a cam shaft design and manufacturing system.

Referring now to FIG. 16, a cam shaft design and manufacturing system 140 is shown. System 140 includes a computer 150, such as a conventional personal computer, with a processor and associated electronic memory. Electrically interconnected to computer 150 is a display 160 and a keyboard 170 for inputting user commands to computer 150. Display 160 is useable to display user prompts and/or outputs of the computer 150, such as numerical data and graphical data.

Interconnected to computer 150 is cam grinding mechanism 180 for grinding a cam shaft based upon inputs received from computer 150. Cam grinding mechanism 180 can be a CNC cam grinding equipment or other equipment to grind a cam shaft from metal stock.

Computer 150 includes programs which permit analysis and optimization of proposed cam and follower designs for pump 20. In particular, computer 150 is programmed by the user with various proposed design parameters, or the computer prompts the user to input one or more proposed design parameters. Computer 150 includes appropriate programs to calculate torque data indicative of the torques applied to the cam shaft of the proposed cam and follower design during operation. The torque data is useable to identify peak torque loads. Also, computer 150 includes appropriate programs for calculating energy consumed values indicative of the energy consumed to rotate the cam shaft of the cam and follower design a predetermined amount. This may include total energy consumed and the separate components that comprise the total energy consumed. A user of computer 150 can study the outputs of the various programs on display 160, and then make one or more changes to the proposed design parameters to optimize the cam and follower design. Once the design is optimized, appropriate programs create a control signal representative of the cam profiles for each cam, and the signal is sent by computer 150 to the cam grinding mechanism 180 where the cam profile or profiles are ground at cam grinding mechanism 180. The follower or followers can be manufactured by various processes utilizing the optimized design parameters, such as injection molding.

In one preferred embodiment, computer 150 permits a user to input the design parameters of: a specified shape for a follower surface of each follower for engaging a cam, a specified follower motion for each of the followers, a specified cam base circle radius for each of the cams, and a specified cam shaft rotation amount. Other variables can be input by the user during the design optimization. Computer 150 preferably permits analysis of a plurality of cams on each cam shaft.

It is preferred that a first program be provided for displaying the torques applied to each cam of the cam shaft in graphical format. A second program may be provided for displaying the total torques applied to the cam shaft in graphical format. A third program may be provided for displaying a profile of the proposed cam in graphical format.

It is to be appreciated that the various programs noted above for computer 150 can be program steps of a single program, or separate programs which are utilized as needed in the design and manufacturing system 140.

The invention is not to be construed as to be limited by the specific embodiments described above or shown in the drawings, but is to be limited only by the broad general meaning of the following claims.

What is claimed is:

1. A pump apparatus comprising:

a rotatably mounted camshaft having a first cam having a cam surface, the camshaft having an axis of rotation, the cam surface of the first cam defining two lobes;

a compressible tube;

a reciprocally mounted first follower having a follower surface engageable with the cam surface of the first cam, the first follower including a tube surface engageable with the tube, the first follower being reciprocally movable in response to rotation of the first cam to compress the tube, the tube exerting a non-linear tube load on the tube surface of the first follower during rotation of the first cam;

wherein the follower surface of the first follower has a convex shape relative to the axis of rotation;

wherein the cam surface of the first cam has a shape which minimizes the energy consumed in rotating the first cam a predetermined amount based on the non-linear tube load, the energy consumed being directly related to the tube load, and wherein the shape of the cam surface of the first cam minimizes the maximum torque applied to the cam in rotating the first cam the predetermined amount based on the non-linear tube load, the maximum torque being directly related to the tube load;

wherein the cam surface of the first cam has an irregular shape which provides the lowest energy consumed requirements and the lowest maximum torques for the non-linear tube load property; and wherein the camshaft is rotatable 180° to complete one activation of the pump apparatus to pump fluid through the tube.

2. The pump apparatus of claim 1, further comprising:

a second cam on the camshaft and having a cam surface, the cam surface of the second cam defining two lobes;

a reciprocally mounted second follower having a follower surface engaged with the cam surface of the second cam, the second follower including a tube surface engaged with the tube, the second follower being reciprocally movable in response to rotation of the second cam to compress the tube, the tube exerting a non-linear tube load on the tube surface of the second follower during rotation of the second cam;

wherein the follower surface of the second follower has a convex shape relative to the axis of rotation of the second cam;

wherein the cam surfaces of the first and second cams have shapes which minimize the total energy consumed in rotating the first and second cams a predetermined amount based on the non-linear tube load, the energy consumer being directly related to the tube load, and wherein the shapes of the cam surfaces of the first and second cams minimize the maximum total torques applied to the first and second cams to rotate the first and second cams the predetermined amount based on the non-linear tube load, the maximum torques being directed related to the tube load; and wherein the cam surface of the second cam has an irregular shape which provides the lowest energy consumed requirements and the lowest maximum torques for the non-linear tube load property.

3. The pump apparatus of claim 2, further comprising:

a third cam on the camshaft and having a cam surface, the cam surface of the third cam defining two lobes;

a reciprocally mounted third follower having a follower surface engaged with the cam surface of the third cam, the third follower including a tube surface engaged with the tube, the third follower being reciprocally movable in response to rotation of the third cam to compress the tube, the tube exerting a non-linear tube load on the tube surface of the third follower during rotation of the second cam;

wherein the follower surface of the third follower has a convex shape relative to the axis of rotation of the third cam;

wherein the cam surfaces of the first, second, and third cams have shapes which minimize the total energy consumed in rotating the first, second, and third cams a predetermined amount based on the non-linear tube load, the energy consumer being directly related to the tube load, and wherein the shapes of the cam surfaces of the first, second, and third cams minimize the maximum total torques applied to the first, second, and third cams during rotation of the first, second, and third cams the predetermined amount based on the non-linear tube load, the maximum torque being directly related to the tube load; and wherein the cam surface of the third cam has an irregular shape which provides the lowest energy consumed requirements and the lowest maximum torques for the non-linear tube load property.

4. The pump apparatus of claim 3, wherein the first follower is an expulsor, the second follower is an inlet valve, and the third follower is an outlet valve.

5. A pump apparatus comprising:

a pressure plate;

a compressible tube;

a rotatably mounted cam shaft having a rotation axis and including:

an inlet valve cam;

an expulsor cam;

an outlet valve cam;

an outlet valve follower having a tube engaging portion and an inlet valve cam engaging portion, the inlet valve follower positioned between the inlet valve cam and the tube to compress the tube against the pressure plate;

an expulsor follower having a tube engaging portion and an expulsor cam engaging portion, the expulsor valve follower positioned between the expulsor cam and the tube to compress the tube against the pressure plate;

an outlet valve follower having a tube engaging portion and an outlet valve cam engaging portion, the outlet valve follower position between the outlet valve cam and the tube to compress the tube against the pressure plate;

wherein the cam shaft includes means for performing one activation of the pump to pump fluid through the tube upon rotation of 180°.

6. The pump apparatus of claim 5, wherein at least one of the inlet valve follower, the expulsor follower, and the outlet follower includes a convex-shaped cam engaging portion defined by a radius relative to the rotation axis.

7. A pump apparatus comprising:

a pressure plate;

a compressible tube;

a rotatably mounted cam shaft having a rotation axis and including:

an inlet valve cam;

an expulsor cam;

an outlet valve cam;

an outlet valve follower having a tube engaging portion and an inlet valve cam engaging portion, the inlet valve follower positioned between the inlet valve cam and the tube to compress the tube against the pressure plate;

an expulsor follower having a tube engaging portion and an expulsor cam engaging portion, the expulsor valve follower positioned between the expulsor cam and the tube to compress the tube against the pressure plate;

an outlet valve follower having a tube engaging portion and an outlet valve cam engaging portion, the outlet valve follower positioned between the outlet valve cam and the tube to compress the tube against the pressure plate;

wherein the inlet valve cam, the expulsor cam, and the outlet valve cam each define two lobes, wherein the cam shaft is rotatable 180° to complete one activation of the pump to pump fluid through the tube.

* * * * *